US009805523B2

(12) United States Patent
Zinchenko et al.

(10) Patent No.: US 9,805,523 B2
(45) Date of Patent: Oct. 31, 2017

(54) DIAGNOSTIC PROCEDURES AND METHOD OF COLLECTING VEHICLES

(71) Applicant: VOLKSWAGEN AG, Wolfsburg (DE)

(72) Inventors: Tetiana Zinchenko, Braunschweig (DE); Andreas Sasse, Braunschweig (DE); Sergio Di Martino, Hannover (DE); Simon Kwoczek, Braunschweig (DE); Felix Richter, Hannover (DE)

(73) Assignee: Volkswagen AG (DE)

( * ) Notice: Subject to any disclaimer, the term of this patent is extended or adjusted under 35 U.S.C. 154(b) by 56 days.

(21) Appl. No.: 14/819,483

(22) Filed: Aug. 6, 2015

(65) Prior Publication Data

US 2016/0093123 A1 Mar. 31, 2016

(30) Foreign Application Priority Data

Sep. 25, 2014 (DE) ..... 10 2014 219 407

(51) Int. Cl.
*G07C 5/00* (2006.01)
*G07C 5/08* (2006.01)
*G06Q 50/00* (2012.01)

(52) U.S. Cl.
CPC ..... *G07C 5/0808* (2013.01); *G06Q 50/01* (2013.01); *G07C 5/008* (2013.01)

(58) Field of Classification Search
None
See application file for complete search history.

(56) References Cited

U.S. PATENT DOCUMENTS 8,140,358 B1 * 3/2012 Ling ..... G06Q 40/08 340/439
8,798,852 B1 * 8/2014 Chen ..... G06F 21/44 701/29.6
9,365,188 B1 * 6/2016 Penilla ..... B60R 25/2018
2005/0091642 A1 * 4/2005 Miller ..... G06F 11/3664 717/124
2005/0165639 A1 * 7/2005 Ross ..... G06Q 30/0267 705/14.64
2008/0177438 A1 * 7/2008 Chen ..... G07C 5/008 701/31.4
2009/0216401 A1 * 8/2009 Underdal ..... G07C 5/0808 701/33.4
2009/0306849 A1 * 12/2009 Blanz ..... G05B 23/0264 701/31.4
2011/0015998 A1 * 1/2011 Hirschfeld ..... G06Q 30/02 705/14.49

(Continued)

OTHER PUBLICATIONS

Ronz; Predictive analytics; edited Sep. 17, 2014; downloaded from https://en.wikipedia.org/wiki/Predictive_analytics.

(Continued)

*Primary Examiner* — Truc M Do
(74) *Attorney, Agent, or Firm* — Barnes & Thornburg LLP

(57) ABSTRACT

A diagnostic method for vehicles from a group of vehicles wherein data relating to at least one vehicle from the group of vehicles are acquired from a social medium. Complaints relating to a criticized characteristic of the at least one vehicle are determined depending on the acquired data. Diagnostic information is generated for at least one vehicle depending on the complaints.

11 Claims, 2 Drawing Sheets

(56) References Cited

U.S. PATENT DOCUMENTS

2011/0225096 A1* 9/2011 Cho ..... G06Q 10/20 705/305
2011/0238647 A1* 9/2011 Ingram ..... G08G 1/20 707/706
2012/0215491 A1* 8/2012 Theriot ..... G07C 5/0808 702/183
2012/0271816 A1 10/2012 Hansberger
2013/0006769 A1* 1/2013 Schalk ..... G06Q 30/0266 705/14.54
2013/0035983 A1* 2/2013 Kursar ..... G06Q 30/0201 705/7.29
2013/0246135 A1* 9/2013 Wang ..... G07C 5/008 705/14.4
2014/0195663 A1* 7/2014 Hirschenberger .... H04W 4/046 709/223
2014/0219571 A1 8/2014 Bhatt et al.
2014/0229391 A1* 8/2014 East, III ..... G06Q 10/20 705/305
2015/0094903 A1* 4/2015 Bell ..... G07C 5/0808 701/31.4
2015/0094929 A1* 4/2015 Bell ..... G07C 5/0808 701/99

OTHER PUBLICATIONS

Search Report for German Patent Application No. 10 2014 219 407.5; May 13, 2015.
Pak, Alexander et al.; "Twitter as a Corpus for Sentiment Analysis and Opinion Mining," pp. 1320-1326, May 1, 2010.
Cambria, Erik et al.; "New Avenues in Opinion Mining and Sentiment Analysis," IEEE Intelligent Systems, IEEE, US Bd. 28 No. 2, pp. 15-21, Mar. 1, 2013.

* cited by examiner

DIAGNOSTIC PROCEDURES AND METHOD OF COLLECTING VEHICLES

PRIORITY CLAIM

This patent application claims priority to German Patent Application No. 10 2014 219 407.5, filed 25 Sep. 2014, the disclosure of which is incorporated herein by reference in its entirety.

SUMMARY

Illustrative embodiments relate to a diagnostic method for vehicles and a collection method for determining a use of vehicle functions. In particular, data from a social medium, for example, an Internet-based social network or an Internet-based discussion platform, are used in the method.

Illustrative embodiments provide a diagnostic method for vehicles from a group of vehicles, a collection method for determining a use of vehicle functions, a diagnostic device, and a device for determining a popularity of a use of vehicle functions.

BRIEF DESCRIPTION OF THE DRAWINGS

Disclosed embodiments are described in detail below with reference to the drawing.

DETAILED DESCRIPTION OF THE DISCLOSED EMBODIMENTS

Figure 1:
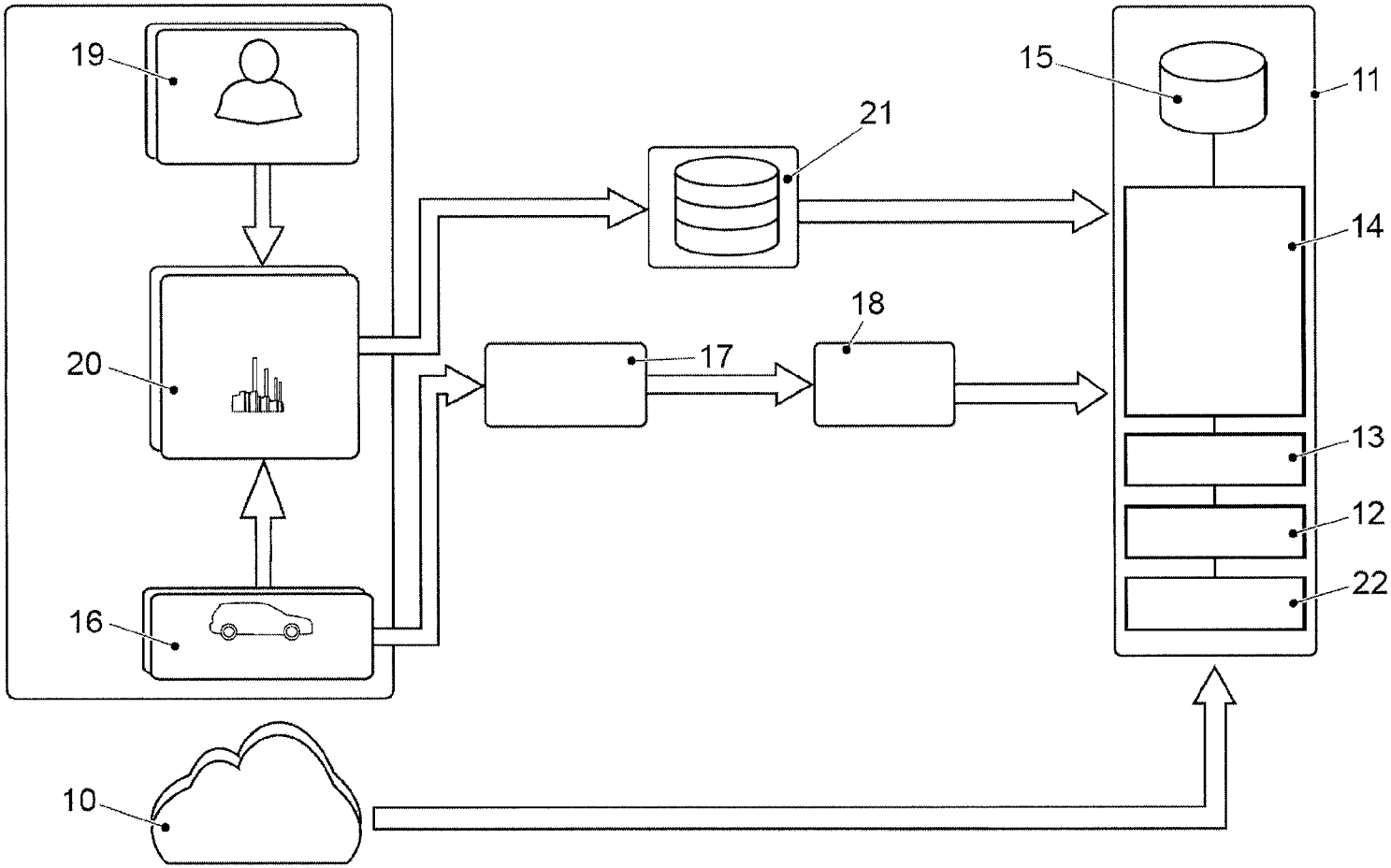
FIG. 1 shows schematically the performance of a diagnostic method according to at least one disclosed embodiment.

Disclosed embodiments provide a diagnostic method for vehicles from a group of vehicles. In the method, data are acquired from a social medium. The data refer to at least one vehicle from the group of vehicles. Depending on the acquired data, complaints are determined which relate to a criticized characteristic of the at least one vehicle. Diagnostic information is generated for the at least one vehicle depending on the complaints. Through the automatic determination of the complaints and ultimately the diagnostic information on the basis of data from social media, faults which occur in components or parts of the vehicle can be detected and identified promptly. Furthermore, the social media provide a broad database. Different complaints may result in similar or identical diagnoses. Due to the broad database, the reliability of the diagnostic information can thus be increased. Furthermore, a distinction can be made due to the broad database as to whether, for example, the failure of a component involves a random failure or a systematic failure. Similarly, for example, in the case of malfunctions of systems of the vehicle, it can be determined whether this malfunction occurs systematically, particularly in the case of specific operating states of the vehicle, or rather has occurred randomly and, for example, is based on a normally prevailing failure probability. In particular, the speed at which the data, complaints and diagnostic information can be derived from the social medium is considerably higher than in the case of comparable information from, for example, workshops, since a complaint in, for example, a blog is normally recorded by a user very promptly, whereas a workshop visit usually takes place only days, weeks or even months later.

The group of vehicles may, in particular, comprise a plurality of vehicles of the same type. Vehicles of the same type have at least one common characteristic, for example the same vehicle type, the same engine type, the same equipment features or the same production period. Information of this type may, for example, be derived from the data acquired from the social medium or may, for example, be allocated to the user who has input the data into the social medium. Since the vehicle type is known, the diagnostic information can be generated more precisely on the basis of the complaint. Furthermore, the diagnostic information can be stored together with the vehicle type so that, as described above, statistics relating to similar or identical diagnostic information can be generated to determine, for example, a random or systematic fault type.

The diagnostic information may, in particular, comprise a fault or a failure of a function or a component of the vehicle. Furthermore, the diagnostic information may comprise a vehicle state or usage conditions of the vehicle in which the complaint was determined. The vehicle state may, for example, comprise a movement state, such as e.g. a speed or a cornering, and also an engine state, for example an engine temperature, coasting, full-load operation, etc. The usage conditions may, for example, comprise a load state or a number of mobile devices currently being used in the vehicle. Conditions and states, for example, in which a specific function or component of the vehicle has failed or has become defective can thereby be determined. More precise causes, for example, of the failure or fault can then be determined from a larger data set of failures or faults of this type.

In at least one disclosed embodiment of the diagnostic method, vehicle diagnostic information is additionally retrieved from a vehicle diagnostic system of one of the vehicles from the group of vehicles depending on the generated diagnostic information. The vehicle from which the vehicle diagnostic information is retrieved may, for example, be the vehicle which the user who input the data into the social medium is currently using, or a vehicle of the same type. In the former case, a consent of the user for a remote retrieval of his vehicle diagnostic information is understandably required. A different vehicle of the same type may, for example, be a vehicle from a vehicle fleet of the manufacturer or a different corresponding test vehicle. Through the retrieval of the vehicle diagnostic information depending on the diagnostic information generated on the basis of the social media, vehicle diagnostic information of a specific area can be retrieved or evaluated in a targeted manner, and this vehicle diagnostic information can be matched with the generated diagnostic information. Faults or failures of functions or components of the vehicle can thus be quickly and reliably determined. Furthermore, the diagnostic information generated on the basis of the social media can be validated in relation to the vehicle diagnostic information generated in the vehicle and the methods which generate the diagnostic information and the vehicle diagram diagnostic information can be optimized accordingly.

In a further disclosed embodiment of the diagnostic method, further data relating to at least one vehicle from the group of vehicles are acquired from further social media and further complaints relating to the criticized characteristic are determined depending on the acquired data. The diagnostic information is additionally generated depending on the further complaints. Through the use of a plurality of social media, the database can be further broadened and the diagnostic information can thus be generated more comprehensively and reliably. Furthermore, the social media from which the data are acquired can be evaluated, for example with reference to their reliability in terms of the quality and correctness of the data published therein, and with reference to the speed at which users input corresponding data. The speed relates to a time interval between the occurrence of the criticized characteristic and the input of corresponding data into the social media. In social media in which only very short messages are normally composed and disseminated, such as, for example, Twitter or Facebook, complaints can be available very soon after their occurrence, but in little detail only. In user forums, information relating to a complaint is not available until later, for example several hours or days later, but then in considerably greater detail. On this basis, the social media can be weighted and a corresponding reliability or quality can be allocated to the complaints and diagnostic information generated therefrom.

In a further disclosed embodiment of the diagnostic method, fault complaints relating to at least one vehicle from the group of vehicles are retrieved from repair databases of workshops and the diagnostic information is additionally generated from the repair databases depending on the fault complaints. The reliability of the diagnostic information can be further increased in combination with the fault complaints from the repair databases.

The data which are input into the social media by a user of the at least one vehicle may, in particular, comprise text messages. Text messages can be reliably evaluated with suitable methods, for example data mining technology, to determine the complaints automatically. Additionally, in the method, additional information can be determined automatically from the data of the social medium, for example an age of a person who input the data into the social medium, a driver profile of the person, for example a frequent driver, long-distance driver, urban driver, sporty driver or defensive driver, a geographical position at which the complaint occurred or the data relating to the complaint were input into the social media, and also, for example, a time or current weather conditions when the complaint occurred or the data relating to the complaint were input. Causes of sporadically occurring faults, for example, can be more simply and reliably diagnosed by taking account of information of this type. If, for example, a specific complaint occurs particularly frequently when it is raining, for example, the cause could be a defective seal of a component of the vehicle.

Disclosed embodiments also provide a collection method for determining a use of vehicle functions by a user of the vehicle. The vehicle functions relate to functions from a specific group of functions of the vehicle. The vehicle functions relate, in particular, to functions which require an operation by the user, for example functions of a navigation system, an entertainment system, a driver assistance function, such as e.g. a parking assistant, a distance warning or distance keeping assistant or a lane departure warning system, or a configuration system of the vehicle for the individual setting of components and functions of the vehicle, such as e.g. an air conditioning setting or a lighting setting for the passenger compartment of the vehicle. The vehicle is a vehicle from a group of vehicles of the same type, i.e. a vehicle from a group of vehicles which have at least one common characteristic, such as e.g. a vehicle type, an engine type, an equipment characteristic or a group of equipment characteristics or a production period. In the method, data relating to at least one vehicle from the group of vehicles are acquired from a social medium. In this context, social media comprise, for example, user platforms, blogs and social networks in which the user publishes, for example, an experience or a query relating to a function of the vehicle. A popularity of the use of a vehicle function from the group of vehicle functions is automatically determined on the basis of the acquired data. If it is determined, for example, on the basis of the acquired data that a specific vehicle function is discussed in the social network only extremely rarely or not at all, the reason for this may, for example, be that this function is essentially not required or is so complicated to operate or to activate that most users do without it.

Popularity generally refers to the popularity of a function or product in a group of people. The popularity of a function or product may, for example, be measured via the Internet. The frequency with which and the context in which this function or product is mentioned on Internet pages can be investigated via suitable search queries. Alternatively or additionally, popularity may be a frequency of a use of a function or product. The frequency of the use may, for example, be determined by means of a corresponding analysis of comments on the Internet or, for example, can be logged electronically in, for example, a database in customer vehicles or fleet vehicles.

In at least one exemplary embodiment of the use of the collection method, the vehicle function relates, for example, to an activation of an automatic air conditioning system or auxiliary heating system of the vehicle using a wireless remote control. The wireless remote control has, for example, four operating elements to pre-heat or pre-cool the vehicle while stationary for either 15 minutes, 30 minutes, 60 minutes, or 120 minutes. By means of the data from the social medium, it becomes clear that times of 15 minutes, 30 minutes and 60 minutes are frequently used, but a time of 120 minutes is only very rarely used. The popularity of the 120-minute time is therefore relatively low. Consequently, a relevant operating element could be omitted from a later design of the wireless remote control. In a further example, data acquired from the social medium may, for example, relate to a configuration menu of a navigation system of the vehicle. For example, a color configuration, inter alia, for a display of the map information on the navigation system could be set in the configuration menu. The data acquired from the social medium indicate that this color configuration is discussed only very rarely and therefore has only a low popularity. As a consequence, for example, the color configuration can be omitted in future or it can be investigated whether the color configuration is complicated to operate or is arranged so inconspicuously in the configuration menu that users only rarely use it.

In at least one disclosed embodiment of the collection method, a further popularity of the use of the vehicle function by users of test vehicles is determined. The test vehicles are, for example, vehicles of the vehicle fleet of the vehicle manufacturer and are of the same type as the vehicles from the group of vehicles to which the data from the social medium relate. The further popularity is validated depending on the popularity determined from the social medium or, conversely, the popularity determined from the social media can be validated using the further popularity. In the case of the test vehicles, every use of a vehicle function by the user can be recorded automatically, for example, using electronic log mechanisms. An expected popularity of the vehicle function can be derived therefrom. By means of a comparison with the actual popularity determined using the data from the social medium, the information determined from the test vehicles can be validated and, in the event of deviations, the test conditions can be adapted or optimized in future tests.

Disclosed embodiments also provide a diagnostic device which comprises an acquisition means for acquiring data from a social medium, a determination device for determining complaints and a processing unit for generating diagnostic information. The data from the social medium relate to at least one vehicle from a group of vehicles, in particular to a group of vehicles of the same type. The complaints relate to a criticized characteristic of the at least one vehicle and are determined depending on the acquired data. The processing device generates the diagnostic information for the at least one vehicle depending on the complaints. The diagnostic device is thus designed to carry out the diagnostic method described above and therefore also comprises the advantages described above.

Disclosed embodiments further provide a device for determining a popularity of a use by a user of vehicle functions of a specific group of functions of a vehicle. In other words, the popularity of a vehicle function with a user is determined using the device. The vehicle relates to a vehicle from a group of vehicles of the same type. The device comprises an acquisition means for acquiring data which relate to at least one vehicle from the group of vehicles and were input by the user into a social medium. The acquisition means furthermore accesses social media such as e.g. blogs or discussion forums, for example via the Internet. The device furthermore comprises a determination device which determines a popularity of use of a vehicle function depending on the acquired data. The device is therefore designed to carry out the collection method described above and offers the advantages described in connection with the collection method.

Freely accessible data acquisition is currently possible due to the substantial growth of social media. Users of social media provide information on functionalities of different vehicle functions and vehicle components and information relating to product reusability, user acceptance or a general opinion on products or individual functions in the social media. The social media comprise, for example, Internet-based user platforms, user forums and blogs. This information may be used as a complement to other information sources, for example databases of vehicle fleet data of the vehicle manufacturer and after-sales data, i.e. data collected, for example, by consulting purchasers following the purchase, or determined from workshop data. Information from social media provides important instant indications of a product weakness, inadequate characteristics or faults, since a high speed at which new messages appear is achieved, i.e. the time between the moment when the user receives corresponding indications and the appearance of a corresponding notification or message in the social medium is relatively short. Conversely, data relating to faults which are detected as customer indications or complaints in a workshop are available only with a certain delay of several days to months during the warranty period and with a considerably longer delay following the end of the warranty period. Corresponding complaints in social media are, on the other hand available within minutes or hours.

Figure 2:
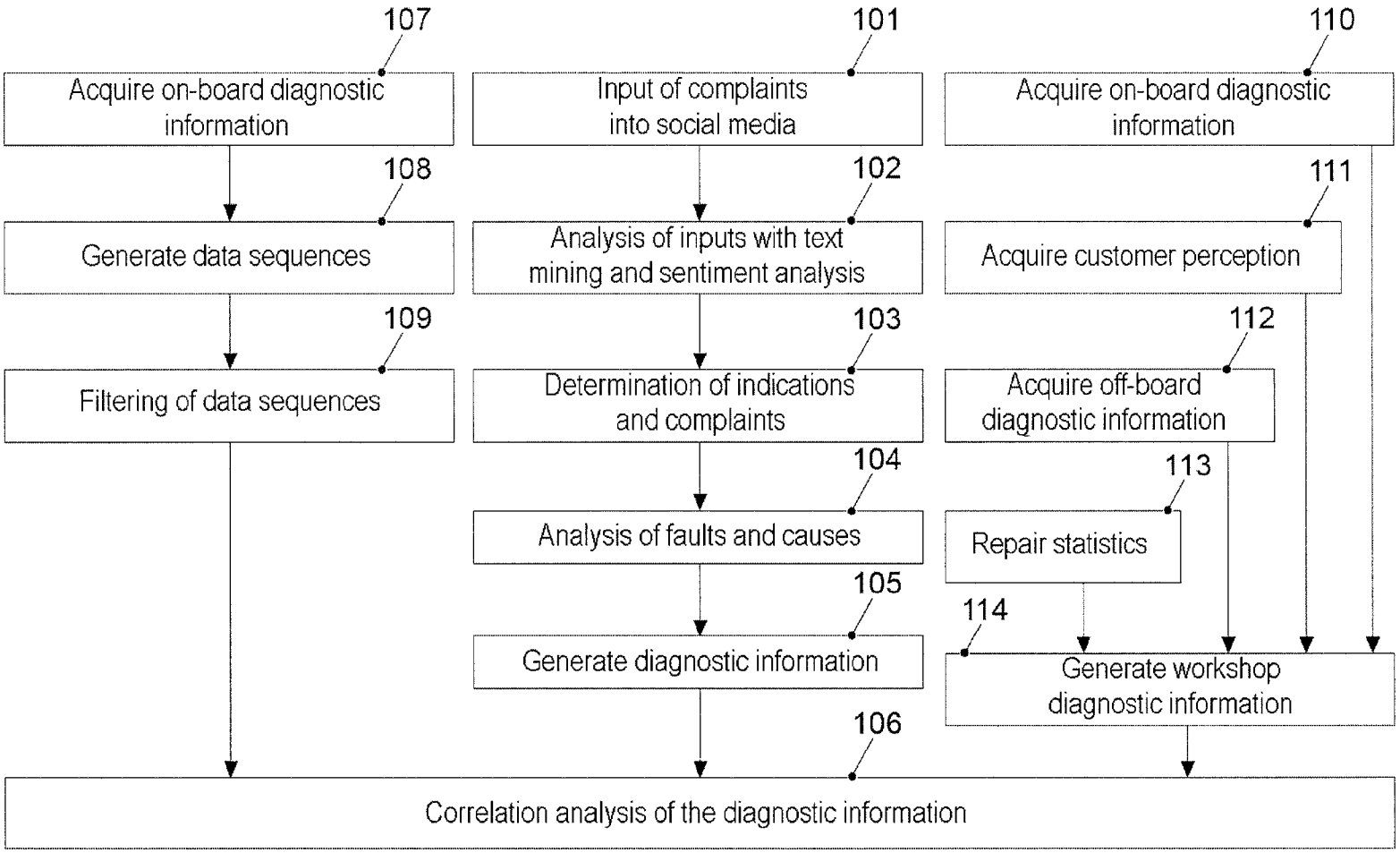
FIG. 2 shows method steps of a diagnostic method according to at least one disclosed embodiment.

FIG. 1 shows data flows and components which can be used to carry out a diagnostic method. Corresponding method steps to carry out the diagnostic method are described below in conjunction with FIG. 2. In step 101, it is provided that a vehicle user inputs complaints relating to a criticized characteristic of a vehicle into a social medium 10, for example a blog or user forum, for example Twitter or Facebook. The complaint may mainly comprise text, i.e. the user inputs a description of the criticized characteristics. Additional information relating to the vehicle type and the circumstances in which the complaint occurred can also be input. Alternatively or additionally, the vehicle type, for example, and/or a current geographical position can be obtained from information of the social medium, for example the vehicle type can be allocated to the user and the geographical information can be acquired and provided automatically by the input means, for example a mobile telephone, with which the user inputs the complaint. Furthermore, additional background information can be provided by the social media, such as e.g. environment information, a driver profile, a social background of the driver, an age of the driver, etc. The information input by the user is frequently unstructured and may relate to a wide range of vehicle components. Text mining methods can therefore be used in step 102 to evaluate this information. Text mining comprises a bundle of algorithm-based analysis methods for revealing meaning structures from unstructured or weakly structured text data. Using statistical and linguistic means, text mining reveals structures from texts to quickly identify core information of the processed texts. Furthermore, in step 102, a "sentiment analysis" can be carried out. Sentiment analysis (also referred to as sentiment detection) is a sub-area of text mining and refers to the automatic evaluation of texts with the aim of detecting an expressed attitude as positive or negative. In step 103, indications or complaints relating to a criticized characteristic of the vehicle used are determined from the analysis of the data and information from the social medium.

In FIG. 1, the determination of these indications and complaints is carried out by a diagnostic server 11. The diagnostic server 11 may comprise an acquisition means 22 for acquiring data from the social medium 10 and a determination device 12 to analyze the data (step 102) and determine the complaint from the data (step 103). In step 104, a fault and cause analysis is carried out with a processing device 13 of the diagnostic server 11 on the basis of the indications and complaints mined in this way in step 103 to thus generate diagnostic information (step 105). This diagnostic information can be fed to a correlation device 14 of the diagnostic server 11. A correlation analysis takes place in the correlation device 14 (step 106). Further diagnostic information from further sources can be included in the correlation analysis. For example, diagnostic information from further social media, workshops and on-board diagnostic systems of vehicles can be considered. To do this, the diagnostic information of the different sources can be collected in a common database, referred to as a data warehouse (DWH) 15, in the diagnostic server 11.

On-board diagnostic information from a vehicle 16 may, for example, be retrieved directly from the vehicle 16 by means of a data transfer. The vehicle 16 may, for example, be a vehicle of a test fleet of the vehicle manufacturer or a customer vehicle, provided that the customer has consented to a corresponding remote data retrieval. As shown in FIG. 1, on-board diagnostic information of the vehicle 16 initially acquired in step 107 is collected in a common data stream 17. In step 108, data sequences comprising, for example, information from the CAN bus systems of the vehicle 16, environment data such as e.g. temperature, air pressure and weather conditions, a geographical position of the vehicle 16 and a vehicle context and a vehicle history are generated from the data stream 17. The data sequences may be transferred in their entirety or may be filtered with a filter 18 in a step 109. Vehicle data that are relevant in terms of the diagnostic information generated in the processing device 13 can be filtered out here. The vehicle data filtered in this way are stored in the database 15 and are used in the correlation analysis (step 106) in the correlation device 14.

Workshop data can furthermore be taken into account in the correlation analysis (step 106) in the correlation device 14. If a customer 19 takes a vehicle 16 to a workshop 20, information can be retrieved, on the one hand, from the on-board diagnosis of the vehicle 16 itself in the workshop 20 (step 110) and, on the other hand, indication descriptions or fault complaints of the customer 19 can be recorded as so-called customer perception (step 111). Further diagnostic information, referred to as off-board diagnostic data, can furthermore be determined on the vehicle 16 with measuring devices of the workshop 20 (step 112). Further diagnostic information can be generated on the basis of this information (step 114). This information can be stored in conjunction with repair statistics in a customer service or workshop database 21 and can be taken into account by the correlation device 14 of the diagnostic server 11 in the correlation analysis.

In the disclosed embodiments, information is used that is provided by vehicles 16, for example, a vehicle fleet of the manufacturer, a customer service database 21, also referred to as an after-sales service data warehouse (ASDWH), and social media 10, referred to as cloud sources. This enables an immediate response to user complaints. If, for example, on the basis of the data of the social media 10, a frequency of complaints relating to a specific function or a vehicle part reaches a predetermined threshold value, a remote diagnosis, for example, can be initiated on further vehicles of, for example, a vehicle fleet of the vehicle manufacturer. A reliable knowledge is thus gathered, indicating whether a large number of faults of a special function or a special part in the vehicle are actually occurring. In addition, a cross-check with the customer service data (ASDWH) can be carried out. A use of social media or other Internet-based information sources can improve this knowledge by providing additional information on causes of the errors that have occurred. Weighting algorithms, for example, can be used to increase the accuracy of the information obtained from the different sources.

Alternatively or additionally, a customer attitude or a technical acceptance of specific products or functions can be determined on the basis of the previously described sentiment analysis and the text mining of social media, and corresponding information determined from fleet data of a vehicle fleet of the manufacturer can be validated in both directions with the information extracted from the social media. For example, it can be determined on the basis of the data acquired in the social medium how different vehicle functions are used by customers and, in addition, the technical acceptance of different vehicle functions and vehicle components. If a very popular or a very unpopular vehicle function is identified, a precise user usage can be determined from the fleet data. This offers the possibility of analyzing why some functions are not used by customers. Corresponding improvements in the functions or components are then required to increase customer acceptance. In addition, a knowledge collection relating to information not normally available can be achieved through the sentiment analysis of the data of the social media 10, for example environment conditions, a driver profile, an age and social background can additionally be acquired.

Free data gathering is currently possible due to the substantial growth of social media. In this context, social media refer to digital media and technologies which enable their users to engage in exchanges with one another and create and disseminate media content. Examples of social media are, for example, blogs, topic platforms and social networks. The social media may be topic-independent, such as e.g. Twitter or Facebook, or they may relate to specific topics, such as e.g. user platforms and forums for, for example, computers, household devices and, in particular, motor vehicles also.

In this context, US 2013/0035983 A1 discloses a system for validating customer complaints about products. The system can comprise a data processing system which is designed to query social media postings which have been made in a media network system of this type about the product. Furthermore, the data processing system is designed to determine, on the basis of the results of the query, how widespread each complaint is. Furthermore, these notifications can be used to support business-related determinations and to configure and place products.

In parallel with this, electronic data processing and networking have also come into use in vehicles, in particular private motor vehicles and trucks, and in their development, as a result of which the complexity of vehicles has risen in terms of both electronic and mechanical components and a multiplicity of new functions can be provided. Due to the increased complexity and the many available functions in modern vehicles, a multiplicity of faults can occur which, however, may have only minor effects on a few functions and are therefore difficult to identify and eliminate. Furthermore, the user of the vehicle with the multiplicity of functions may be overburdened and therefore able to use only a restricted subset of the existing functions. A need therefore exists to eliminate or at least alleviate the shortcomings described above.

REFERENCE NUMBER LIST

10 Social medium
11 Diagnostic server
12 Determination device
13 Processing device
14 Correlation device
15 Database
16 Vehicle
17 Data stream
18 Filter
19 Customer
20 Workshop
21 Database
22 Acquisition means
101-114 Step

The invention claimed is:

1. A server-based diagnostic method for vehicles of a group of vehicles, the diagnostic method comprising:

acquiring data relating to at least one vehicle from the group of vehicles, from a social medium;

automatically determining, via determination device, complaints relating to a criticized characteristic of the at least one vehicle, depending on the acquired data; and generating diagnostic information, via a processing device, for the at least one vehicle depending on the complaints, retrieving vehicle diagnostic information from a vehicle diagnostic system of a vehicle from the group of vehicles depending on the generated diagnostic information, and validating the diagnostic information generated based on the vehicle diagnostic information retrieved, wherein the social medium is a blog or user forum, determining a popularity of the use of a vehicle function from the group of vehicle functions, based on frequency of use of the vehicle function as determined by analysis of the acquired data, automatically electronically logging, via electronic log mechanisms in a fleet of vehicles, every use of a vehicle function by users of the fleet of vehicles to determine an actual popularity of the vehicle function based on an actual frequency of use by the users, and validating the popularity of the use of the vehicle function based on the acquired data from the social medium by comparing the determined popularity with the actual popularity.

2. The diagnostic method of claim 1, further comprising:

acquiring additional data relating to at least one vehicle from the group of vehicles from an additional social medium;

determining additional complaints relating to the criticized characteristic, depending on the acquired additional data; and wherein the diagnostic information generated is based on the additional complaints.

3. The diagnostic method of claim 1, further comprising:

retrieving fault complaints from repair databases of workshops relating to at least one vehicle from the group of vehicles; and generating the diagnostic information furthermore depending on the fault complaints.

4. The diagnostic method of claim 2, further comprising:

evaluating the social media depending on the complaints determined from the data of the social media and the fault complaints from the repair databases; and weighting the social media depending on the evaluation.

5. The diagnostic method of claim 1, wherein the data comprise a text message composed by a user of the at least one vehicle.

6. The diagnostic method of claim 1, further comprising:

determining additional information from the data of the social medium, wherein the additional information comprises at least information from a group comprising:

an age of a person who input the data into the social medium, a driver profile of a person who input the data into the social medium, a geographical position at which the complaint occurred or the data relating to the complaint were input into the social medium, a time when the complaint occurred or the data relating to the complaint were input into the social medium, and weather conditions prevailing when the complaint occurred or the data relating to the complaint were input into the social medium.

7. The diagnostic method of claim 1, wherein the group of vehicles comprises a plurality of vehicles of the same type, wherein the vehicles of the same type have at least one common characteristic from a group, comprising:

vehicle type;

engine type;

equipment characteristic; and production period.

8. The diagnostic method claim 1, wherein the diagnostic information has at least information from a group, comprising:

a fault of a function of the vehicle;

a failure of a function of the vehicle;

a fault of a component of the vehicle;

a failure of a component of the vehicle;

a vehicle state in which the complaint was determined; and a usage condition in which the complaint was determined.

9. A diagnostic device, comprising:

server that acquires data relating to at least one vehicle from a group of vehicles, from a social medium;

a determination device for automatically determining complaints relating to a criticized characteristic of the at least one vehicle, based on the acquired data; and a processing device for generating diagnostic information via a fault and cause analysis to determine a malfunction for the at least one vehicle based on the complaints determined and complaints stored in a database in communication with the processing device, electronic log mechanisms that automatically record every use of vehicle functions by users of a fleet of vehicles and communicate the recordings data to the acquisition means, wherein the determination device determines and validates a popularity of a use of a vehicle function from the vehicle functions, based on frequency of use of the vehicle function as determined by analysis of the acquired data and correlation to the recordings data, wherein the social medium is a blog or a user forum.

10. The method of claim 1, wherein the diagnostic information comprises malfunction of a component of the vehicle, wherein a database stores the diagnostic information with other similar diagnostic information and the processing device determines the malfunction occurs systematically when the malfunction is diagnosed more frequently than a normally prevailing failure probability.

11. The method of claim 10, wherein the processing device determines the malfunction occurs randomly when the malfunction is diagnosed less frequently than the normally prevailing failure probability.

* * * * *